US005839909A

United States Patent [19]

Calderara et al.

[11] Patent Number: 5,839,909

[45] Date of Patent: Nov. 24, 1998

[54] SHUTTER DEVICE FOR CLOSING OFF THE COMPARTMENTS OF A POWER SOCKET

[75] Inventors: Ennio Calderara, Cuasso Al Piano; Gianmaria Carabelli, Induno Olona, both of Italy

[73] Assignee: Bticino, S.p.A., Italy

[21] Appl. No.: 751,145

[22] Filed: Nov. 15, 1996

[30] Foreign Application Priority Data

Jul. 30, 1996 [IT] Italy ..... MI96A1630

[51] Int. Cl.[6] ..... H01R 13/44

[52] U.S. Cl. ..... 439/137; 439/145

[58] Field of Search ..... 439/137, 145

[56] References Cited

U.S. PATENT DOCUMENTS 4,722,693 2/1988 Rose ..... 439/145

4,867,694 9/1989 Short ..... 439/145

5,020,997 6/1991 Calderara et al. ..... 439/137

5,026,299 6/1991 Foulk ..... 439/137

*Primary Examiner*—Neil Abrams

*Assistant Examiner*—Eugene G. Byrd

[57] ABSTRACT

Shutter device for closing off the compartments of a power socket that has a live aperture and a neutral aperture in a front plate. The shutter device comprises a shutter piece that moves translationally between a rest position, in which the live and neutral apertures are closed, and an operational position in which they are not closed. The shutter piece comprises two arms positioned against the live and neutral apertures in the rest position and inclined at an angle to the direction of translation of the shutter piece.

8 Claims, 4 Drawing Sheets

SHUTTER DEVICE FOR CLOSING OFF THE COMPARTMENTS OF A POWER SOCKET

FIELD OF THE INVENTION

The present invention relates to a shutter device for closing off compartments of a power socket.

DESCRIPTION OF THE PRIOR ART

A typical power socket consists of an insulating body, generally made up of two shells fastened together, housing a plurality of compartments each of which contains a metal spring contact for connection to an electrical mains. In particular, the power socket comprises a live compartment and a neutral compartment, each of which houses a metal spring contact for connection to a first (live) and second (neutral) power supply cable, respectively; typically, the power socket also includes a third or earth (aka: ground) compartment housing a metal spring contact for connection to an ground cable connected to something of practically zero potential (earth).

On a front plate of the insulating body of the power socket are typically front apertures for accessing access to the compartments; in the power socket described above there are two front apertures for access to the live and neutral compartments, respectively, and a third front aperture for access to the ground compartment. The shape and position of the front apertures giving access to the compartments vary from country to country and are prescribed by different standards.

When a power plug comprising a plurality of contact pins is inserted in the power socket, the various pins are pushed into the insulating body through corresponding access apertures on the front, until they reach the compartments and contact the corresponding metal spring contacts.

Power sockets are often fitted with a shutter device which prevents access under certain conditions to the live and neutral compartments through the corresponding front apertures. This shutter ensures that an inappropriate conducting item (for example, a nail) cannot be inserted into the power socket and contacted with a metal spring contact connected to a power supply cable. The shutter prevents accidental contact with live electrical parts and is highly useful as a safety device, for example when there are children around. The shutter device is generally fitted inside the insulating body of the power socket between the front apertures and the compartments and is moveable between a rest position in which it closes off the front apertures and an operational position in which it offers free access to the live and neutral compartments.

A number of different types of mechanism are possible for operating these shutter devices. Some shutter devices are constructed so as to allow access to the live and neutral compartments only when a pair of pins are simultaneously inserted into the front apertures leading to these. Other shutter devices are constructed in such a way that the insertion of a pin into the front aperture giving entrance to the earth compartment moves the shutter device, which in turn allows the insertion of the power supply plug. It can be seen that this shutter device still allows any object to be pushed in through the front earth aperture; this does not however create any risk since this aperture gives access to a compartment housing a metal spring contact connected to the ground cable, which is therefore not live.

One particular kind of shutter device that is especially simple to manufacture consists of a shutter piece provided with a shutter plate which in the rest position is behind the front apertures giving access to the live and neutral compartments, and is moved translationally between the rest position and the operational position.

A particular power socket will now be considered in which the front apertures are rectangular with their longitudinal axes inclined at an angle to the direction of translation of the shutter device, as illustrated in the front views of FIGS. 1*a* and 1*b*. The figures both show a power socket that comprises a front plate 110 with a front live aperture 120 and a front neutral aperture 130. Behind the front plate 110 is a shutter plate 140 (depicted in dashes) moveable along a direction of translation 150. As illustrated in the figures, the front apertures 120 and 130 are rectangular and are so arranged that their longitudinal axes 160 and 170, respectively, are inclined at an angle to the direction of translation 150.

The shutter plate 140 is illustrated in FIG. 1*a* in a rest position in which it closes off the front live 120 and neutral 130 apertures and in FIG. 1*b* in an operational position in which it offers free access to them. It can be observed that in order to move between the rest position and the operational position, the shutter plate 140 requires a travel equal to at least the height of the front apertures 120 and 130 along the direction of translation 150. This travel is marked d1 in FIG. 1*b*.

These shutter devices therefore require considerable working space and may be impossible to use where the dimensions of the front plate of the power socket have to be kept within tight limits.

SUMMARY OF THE INVENTION

It is an object of the invention to overcome these drawbacks of the prior art. The present invention provides a shutter device for closing off the compartments of a power socket that has a front plate with a first and a second front apertures giving access to a live compartment and to a neutral compartment, respectively, the shutter device fitting between the front plate and the compartments and comprising a shutter piece moveable along a direction of translation between a rest position in which the front apertures are closed and an operational position in which the front apertures are open, the first and second front apertures being essentially rectangular with a first and a second longitudinal axes, respectively, inclined at an angle to the direction of translation, wherein the shutter piece has a first and a second arms which in the rest position are behind the first and second front apertures, respectively, and which have a first and a second edges, respectively, that are essentially parallel with the first and second longitudinal axes, respectively, and that pass over the first and second front apertures, respectively, during a movement between the rest position and the operational position.

The shutter device in accordance with the present invention has a shape such as to require a short travel and hence less working space. It is structurally very simple, is reliable and is simple to mass produce. Furthermore, the shutter device in accordance with the present invention requires no special modifications to the insulating body of the electrical socket to which it must be fitted and can therefore also be used with standard power sockets.

BRIEF DESCRIPTION OF THE DRAWINGS

A number of different embodiments of the present invention will now be described by means of examples, offered by way of indication and without implying any restriction, with reference to the accompanying drawings in which.

DETAILED DESCRIPTION OF THE PREFERRED EMBODIMENTS

Figure 1A:
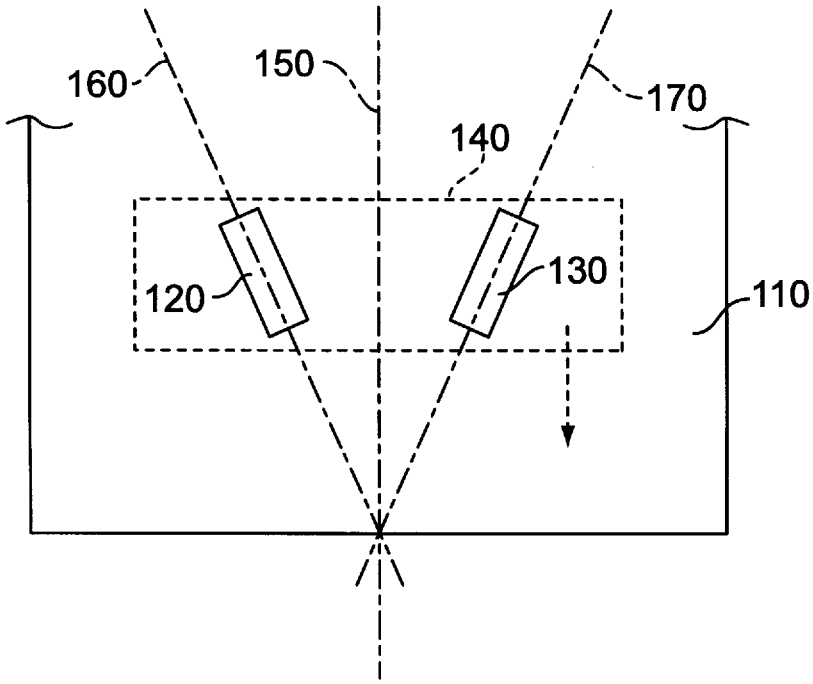
FIGS. 1*a* and 1*b* show respective front views of a known shutter device in different functional positions.
Figure 1B:
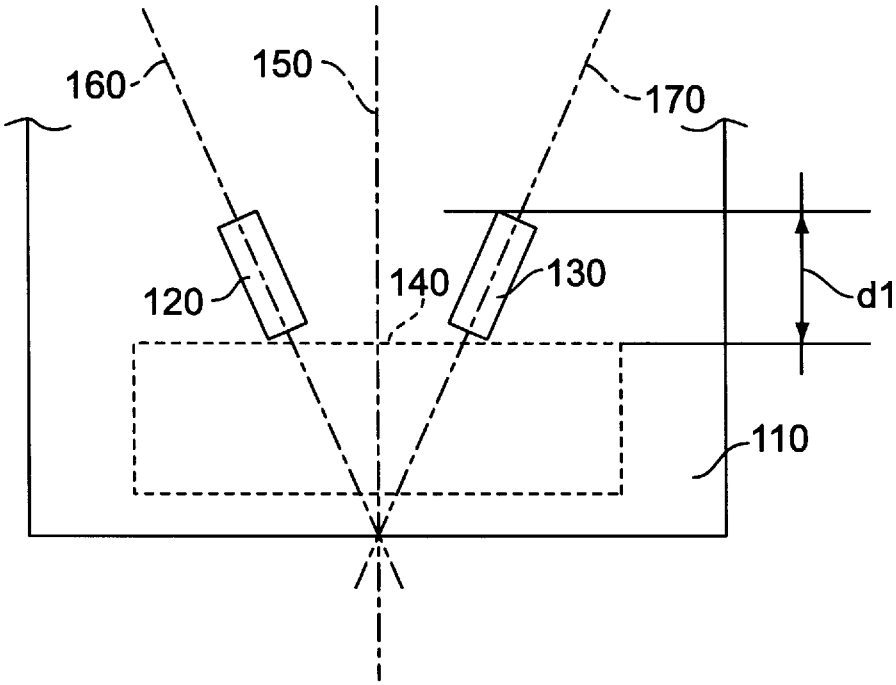
Figure 2A:
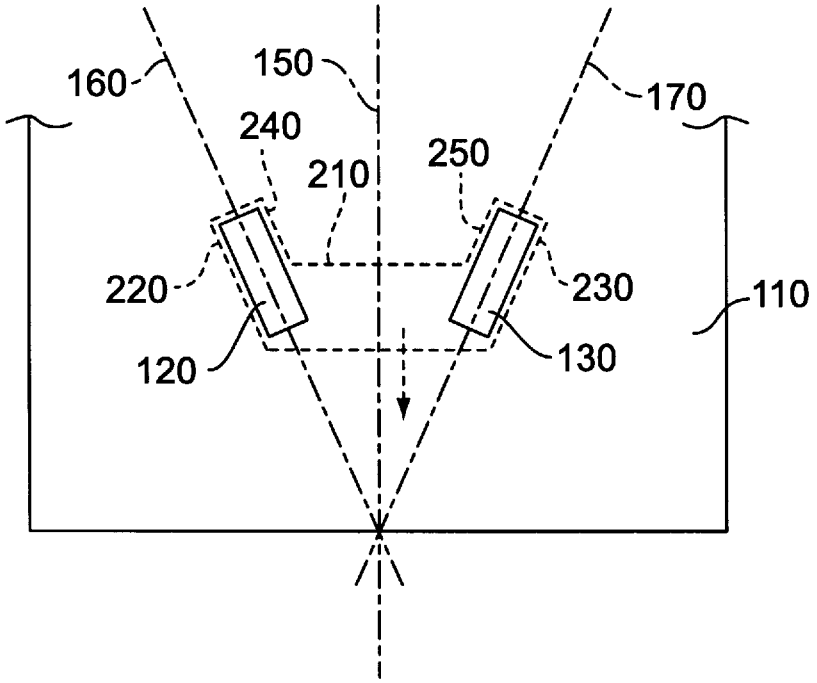
FIGS. 2*a* and 2*b* show respective front views of the shutter device in accordance with the present invention in different functional positions.
Figure 2B:
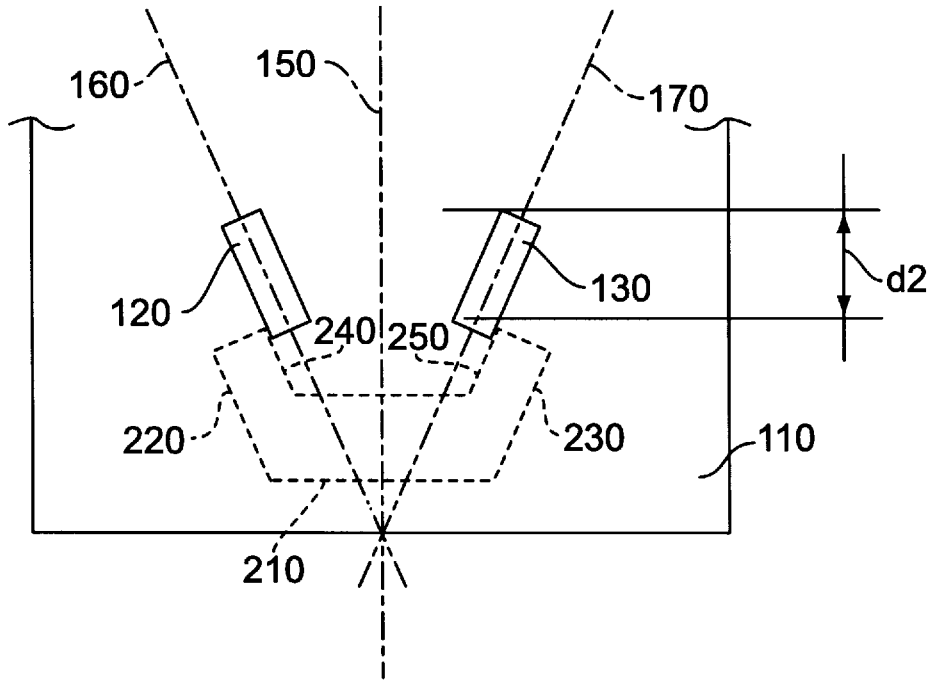

With reference now to the figures, and in particular with reference to FIGS. 2*a* and 2*b* (FIGS. 1*a* and 1*b* having been described earlier), a front view is shown of a power socket incorporating the shutter device in accordance with the present invention in the rest position and operational position respectively (parts common to the power socket of FIGS. 1*a* and 1*b* bear the same reference numerals).

The power socket illustrated comprises a front plate 110 with a live front aperture 120 and a neutral front aperture 130. Behind the front plate 110 is a shutter device comprising a shutter piece 210 (shown in dashes) that can be moved along a direction of translation 150. The front apertures 120 and 130 are rectangular and their longitudinal axes, 160 and 170 respectively, are inclined at an angle to the direction of translation 150.

The shutter piece 210 has two arms 220 and 230 which, in the rest position shown in FIG. 2*a*, are located behind the live front aperture 120 and the neutral front aperture 130, respectively. The two arms 220 and 230 have respective edges 240 and 250 which are essentially parallel with the longitudinal axes 160 and 170, respectively. When the shutter piece 210 moves out of the rest position of FIG. 2*a* into the operational position of FIG. 2*b*, the edges 240 and 250 pass over the live front aperture 120 and neutral front aperture 130, respectively.

The particular shape and arrangement of the arms 220 and 230 allows the front apertures 120 and 130 to be cleared with a short travel of the shutter piece 210, this travel being marked d2 in FIG. 2*b*. The shutter device in accordance with the present invention therefore offers the advantage of requiring a shorter travel of the shutter piece 210 than is necessary with known devices, and hence reduces the size of the whole shutter device and enables it to be used even in power sockets of restricted dimensions.

Figure 2C:
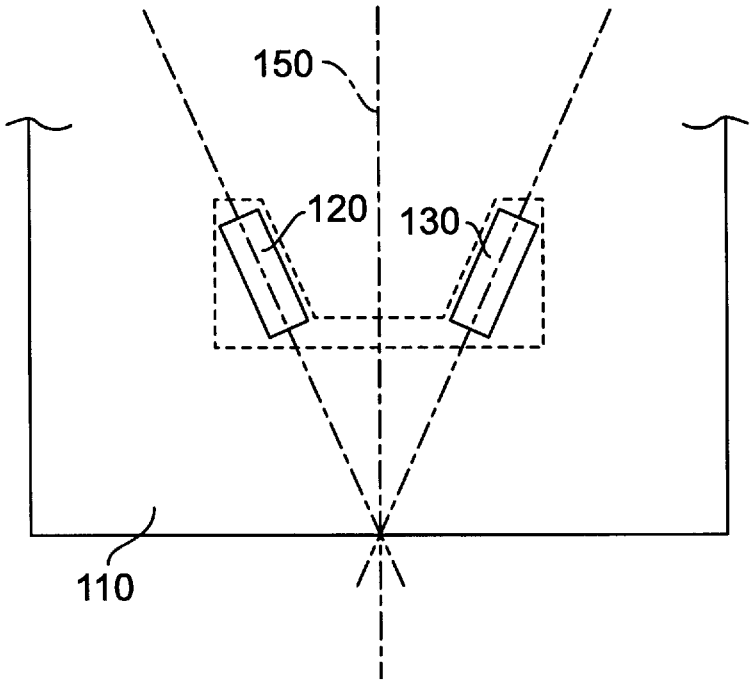
FIGS. 2*c* and 2*d* show in front view two different embodiments of the shutter device in accordance with the present invention.
Figure 2D:
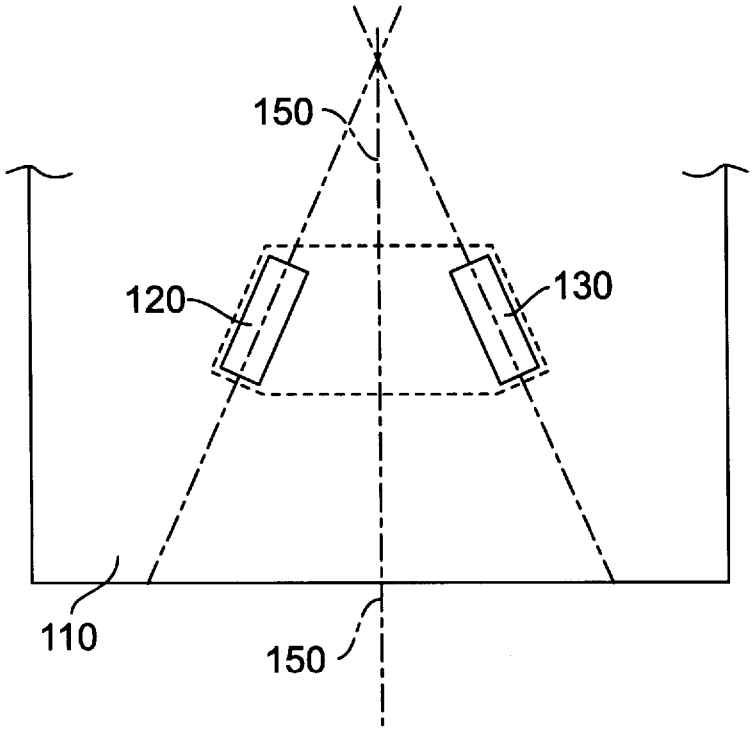

Those skilled in the art will recognize that the shutter device in accordance with the present invention can also be made in shapes other than that of the example shown in FIGS. 2*a* and 2*b*, as illustrated in certain alternative embodiments shown in FIGS. 2*c* and 2*d*.

Figure 3:
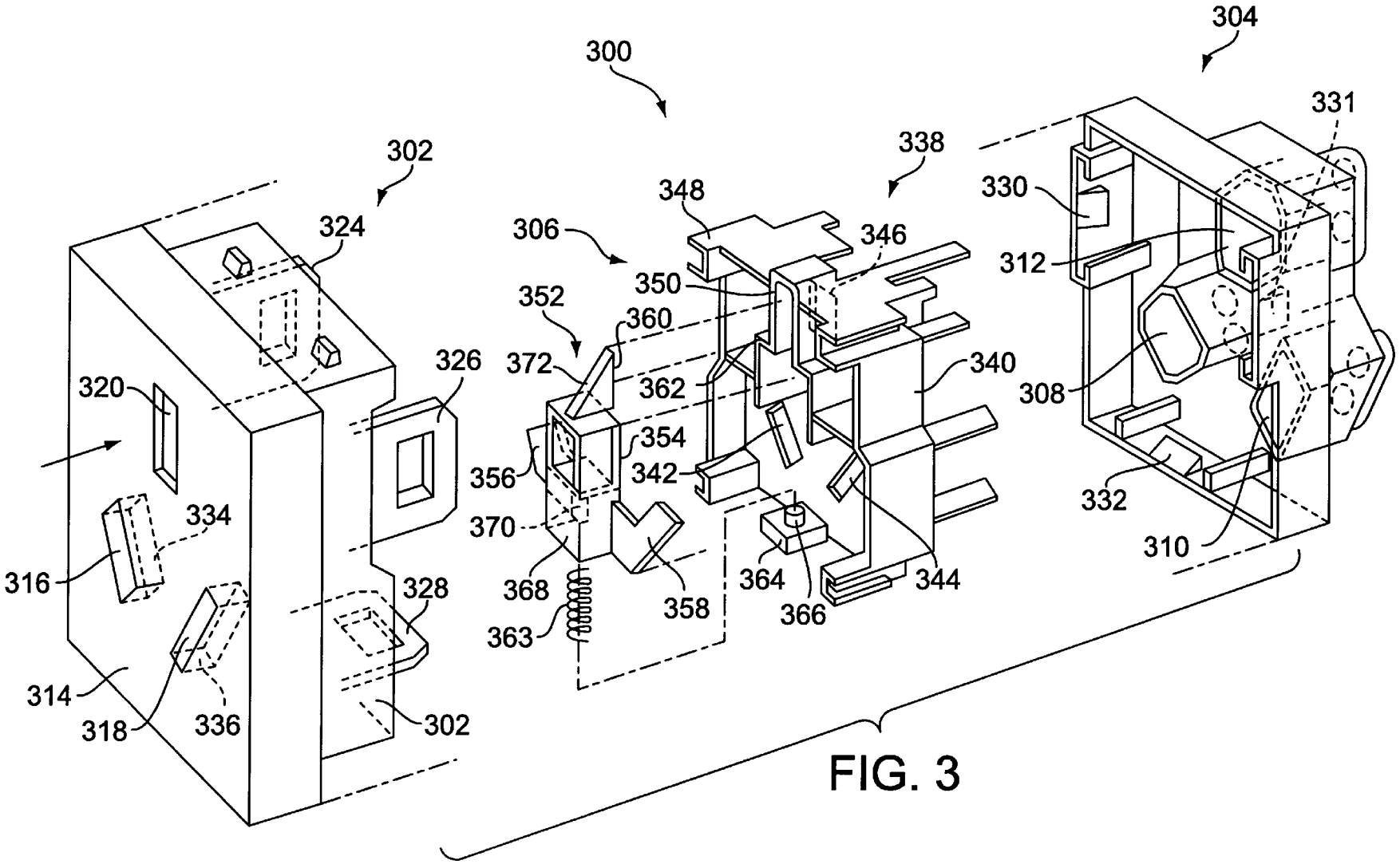
FIG. 3 is an exploded perspective view of a power socket incorporating a preferred embodiment of the shutter device in accordance with the present invention.

With reference now to FIG. 3, an exploded perspective view is shown of a power socket incorporating a preferred embodiment of the shutter device in accordance with the present invention.

The electrical power socket 300 consists of an insulating body formed by a front shell 302 and a rear shell 304, with a shutter device 306 fitted between the two.

The rear shell 304 houses three compartments, each of which contains a metal spring contact (not shown in the figures) for connection to an electrical mains. In particular, the rear shell 304 comprises a live compartment 308 and a neutral compartment 310 which house two metal spring contacts for connection to two power supply cables, one live and one neutral, respectively. A third or ground compartment 312 houses a metal spring contact for connection to a ground cable; in electrical systems without a ground cable, the latter metal spring contact is left free.

The front shell 302 comprises an essentially flat front plate 314 containing front apertures giving access to the compartments. The front plate 314 comprises two front apertures 316 and 318 giving access to the live compartment 308 and neutral compartment 310, respectively, and a front earth aperture 320 giving access to the earth compartment 312. As shown in the figures, each front aperture is in front of its corresponding compartment.

The front apertures 316–320 are essentially rectangular with rounded corners; the front or earth aperture 320 is, furthermore, not in line with the front apertures 316 and 318, which are inclined at an angle to the direction defined by the front or earth aperture 320. This particular electrical socket (which is common in Australia, China and Thailand, for example) is used in connections with power plugs having three flat pins arranged in the same way as the corresponding front apertures.

The front shell 302 comprises a rectangular frame 322 projecting perpendicularly to the plane of the front plate 314 towards the interior of the power socket. The rectangular frame 322 is provided with a plurality of spring tabs which project perpendicularly to the plane of the front plate 314 in the same direction as the rectangular frame 322. In the example illustrated in the figure, there are three spring tabs 324, 326 and 328, each of which is situated on one side of the rectangular frame 322. Each of the spring tabs 324–328 ends in a locking slot to enable the front shell 302 to be snap-fastened onto the rear shell 304, which has three locking teeth 330, 331 and 332 located in corresponding positions to the three slots present on the respective spring tabs 324, 326 and 328.

The front shell 302 comprises two more frames 334 and 336 formed around the front apertures 316 and 318, respectively, and projecting perpendicularly to the plane of the front plate 314 in the same direction as the rectangular frame 322, though not as far as the latter. These frames 334 and 336 form a guide for pins that will be inserted in the front apertures 316 and 318, as described in detail below.

The shutter device 306 comprises an essentially flat rear plate 338 which, when the socket is assembled, is arranged parallel to the plane defined by the front plate 314. Around the perimeter of the rear plate 338 is a frame 340 projecting perpendicularly to the plane of the rear plate 338 in both directions. The shape and dimensions of the rear plate 338 are such as to allow the shutter device 306 to be fastened with limited play inside the housing formed on the front shell 302 by the rectangular frame 322 and by the tabs 324–328.

Additional rear apertures are formed in the rear plate 338 with shapes and dimensions corresponding essentially to the front apertures 316–320 present on the front plate 314. The rear apertures are Positioned on the rear plate 338 in such a way that, when the shutter device 306 is inserted into the housing formed on the front shell 302 by the rectangular frame 322 and tabs 324–328, each of the rear apertures is in line with a corresponding front aperture. In particular, a rear live aperture 342 and a rear neutral aperture 344 30 are in line with the front live aperture 316 and front neutral aperture 318 respectively, while rear earth aperture 346 is in line with the front earth aperture 320.

It should be observed that in the embodiment of the present invention described in the figure, the frame 322 is essentially rectangular (not square) and is provided with three tabs 324–328 only, so that one side of the frame 322 is left free. In this way the shutter device 306 can be inserted into the housing formed by the rectangular frame 322 and tabs 324–328 in only one correct position in which the various rear apertures 342–346 are in line with the corresponding front apertures 316–320. The rectangular shape of the housing and the presence of only three tabs stop the shutter device 306 from being inserted in a different position rotated relative to the correct position (for example by 90° or 180° in either clockwise or anticlockwise directions). This feature is particularly useful when the insulating body of the power socket is being assembled, as it prevents accidental misassembly. Those skilled in the art will recognize that the same result can be obtained with any other asymmetrical form of the rear plate 338 and of the corresponding housing formed on the front shell 302 such that they can be fastened together only with the rear plate 338 orientated in one defined direction.

The rear plate 338 is provided with projections 348 projecting perpendicularly to the plane of the rear plate 338 in both directions. The length of the projections 348 is such that, when the shutter device 306 is inserted into the housing formed on the front shell 302 by the rectangular frame 322 and by the tabs 324–328, and the rear shell 304 is then snap-fitted over the front shell 302, the shutter device 306 is basically fixed within the insulating body of the electrical power socket.

On that face of the rear plate 338 which, when the electrical power socket is assembled, is towards the front plate 314, a guide 350 is formed in relief around the rear earth aperture 346. Other relief parts are provided on both faces of the rear plate 338, in order to give it increased strength.

The guide 350 defines a housing for a shutter piece 352. The shutter piece 352 comprises a central body 354 of essentially parallelepipedal shape, free to move within the guide 350 parallel to the plane defined by the rear plate 338. It should be observed that the central body 354 of the shutter piece 352 has a length in the direction perpendicular to the plane defined by the rear plate 338 slightly less than that of the turrets 348 which project from the rear plate 338 towards the front plate 314 so that, when the power socket is assembled, the shutter piece 352 is contained with limited play between the front plate 314 and the rear plate 338.

Projecting from the central body 354 of the shutter piece 352 are three shutter arms 356, 358 and 360. The two arms 356 and 358, in particular, project symmetrically from the central body 354, in such a way that the entire shutter piece 352 is in the approximate shape of an anchor.

The shutter piece 352 is free to move between a rest (or closed) position and an operational (or not-closed) position. The rest position is defined by the interference between the central body 354 and a stop shoulder 362 present in the guide 350. In this position, the arms 356 and 358 are behind the live 316 and neutral 318 front apertures, respectively, while the arm 360 is behind the front earth aperture 320.

The shutter piece 352 is held in the rest position by an elastic means 363, e.g. a helical spring. The spring 363 is mounted between the rear plate 338 and the shutter piece 352 itself. More specifically, the rear plate 338 possess a shoulder 364 projecting from the face nearest the front plate 314 perpendicularly from the plane of the latter; the shoulder 364 comprises a peg 366 directed towards the guide 350 to engage one end of the spring 363. The central body 354 of the shutter piece 352 comprises, in turn, a recess 368 having a wall fitted with another peg 370 directed towards the shoulder 364 to engage another end of the spring 363. It will be seen that this particular system of engaging the helical spring 363 makes the assembling of the shutter device 306 very simple; the presence of a special cavity for the helical spring 363 in the form of the recess 368 also makes the structure comparatively stable even when the shutter device 306 is not fitted in the power socket 300. It is thus possible to assemble the shutter device 306 in advance and then transfer it, already fully assembled.

The arms 356 and 358 corresponding to the front apertures 316, 318 and rear apertures 342, 346 are of a basically flat structure parallel to the plane of the rear plate 338. The two arms 356 and 358 project in opposite directions from the central body 354 on its face nearest the rear plate 338; the two arms 356 and 358 are inclined at an angle to the direction of translation of the shutter piece 352.

In the rest position of the shutter part 352, the arms 356 and 358 therefore prevent any object from being inserted into the power socket and coming into contact with a metal spring contact connected to a power supply cable. It will be seen that the frames 334 and 336 formed on the front plate 314 form a guide for the pins to be inserted into the corresponding front live 316 and neutral 318 apertures; these frames 334 and 336 are shorter than the projections 348 that project towards the front shell 302, so that when the power socket is assembled they do not obstruct the movement of the arms 356 and 358 past the rear live 342 and neutral 344 apertures.

The arm 360 corresponding to the front 320 and rear 346 earth apertures is, however, provided with a plane 372 facing the corresponding front ground aperture 320 and inclined at an angle to the parallel planes defined by the front plate 314 and the rear plate 338; in particular, the inclined plane 372 slopes away from that face of the central body 354 which is positioned against the front plate 314 until it reaches the plane defined by that face of the central body 354 which is positioned against the rear plate 338. The inclined plane 372 intersects the plane of the rear plate 338 and divides it into two half-planes; the same inclined plane 372 forms with the half-plane containing the rear apertures 342 and 344 an acute angle, preferable of 45°.

In this way, a force applied to the inclined face 372 by any object through the front earth aperture 320 (indicated by an arrow in the figure) will include a component acting in the direction of translation of the shutter piece 352 down the guide 350 which, by countering the action of the spring 363, tends to move the shutter piece 352 into the operational position, in which the arms 356 and 358 are no longer behind the live 316 and neutral 318 front apertures, respectively. Consequently, when a power plug is pushed into the socket, the contact pin corresponding to the front earth aperture moves the shutter piece 352 into the operational position, thereby enabling the other contact pins to be pushed through the corresponding front live and neutral apertures.

It can be seen that, because the arms 356 and 358 are at a distance from the front plate 314, the pin of the power plug inserted through the front earth aperture always comes into contact with the arm 360 before the other pins can reach the arms 356 and 358; in this way, when these pins reach the depth of insertion into the power socket corresponding to the arms 356 and 358, the latter have already been moved out of the rest position under the action of the force applied to the arm 360, thus allowing the power plug to be inserted correctly.

What is claimed is:

1. A protective shutter assembly for closing off a compartment of a power socket, said power socket having a front plate with first and second essentially rectangular front apertures for accessing live compartment and a neutral compartment, respectively of said power socket, the protective shutter being positioned between the front plate and the compartments and comprising:

a shutter piece moveable along a direction of translation between a first, rest position in which the front apertures are closed and a second, operational position in which the front apertures are opened, said first and second front apertures having first and a second longitudinal axes, respectively, inclined at an angle to the direction of translation of said shutter piece; the shutter piece having first and second arms which, in the first, rest position, are disposed behind the first and second front apertures, respectively, and first and a second edges, respectively, extending essentially parallel with respect to the first and second longitudinal axes, respectively, said first and second edges passing over the first and second front apertures, respectively, during a movement between said first rest position and said second, operational position; and wherein said power socket has a third front aperture in said front plate for accessing ground compartment, and wherein said shutter piece has an associated elastic position retention device and a third arm which, in the first, rest position, is disposed in front of the third front aperture, the third arm being provided with an inclined plane forming, with the plane defined by the front plate, an angle such that a force applied to the inclined plane exerts a force tending to move the shutter piece from the first, rest position to the second, operational position in opposition to said elastic position retention device.

2. The shutter assembly according to claim 1, in which the first and second arms are symmetrical with respect to the direction of translation of the shutter piece.

3. The shutter assembly according to claim 1, further comprising a rear plate disposed between the front plate and the said compartments in a plane approximately parallel to the plane defined by the front plate, said rear plate having first, second and third rear apertures corresponding to the first, second and third front apertures, respectively, and wherein the shutter piece is positioned between the front plate and the rear plate.

4. The shutter assembly according to claim 3, wherein the rear plate is asymmetrically shaped and the front plate comprises a frame having a shape that essentially matches the shape of the rear plate thereby allowing the front and rear plates to be fastened together only when each of the rear apertures is in front of the corresponding front aperture.

5. The shutter assembly according to claim 3, wherein said shutter piece further includes a recess and wherein the elastic, position retention device comprises a helical spring fixed between the rear plate and said recess.

6. The shutter assembly according to claim 3, in which the rear plate comprises a guide for moving the shutter piece along said direction of translation.

7. The shutter assembly according to claim 6, wherein said guide includes a stop shoulder acting on the shutter piece to define said first, rest position.

8. A power socket comprising a front insulating shell and a rear insulating shell supporting a live compartment and a neutral compartment, the front insulating shell having a front plate with first and second front apertures giving access to the live compartment and the neutral compartment, respectively, the power socket further comprising a shutter device disposed between the front plate and said compartments for closing off the compartments, the shutter device comprising a shutter piece moveable along a direction of translation between a rest position, in which the front apertures are closed, and an operational position in which the front apertures are opened, the first and second front apertures being essentially rectangular and having first and a second longitudinal axes, respectively, inclined at an angle to the direction of translation; the shutter piece further having first and second arms which, in the rest position, are disposed behind the first and second front apertures, respectively, and which have first and second edges, respectively, extending essentially parallel with respect to the first and second longitudinal axes, respectively, said edges passing over the first and second front apertures, respectively, when said shutter piece moves between the rest position and the operational position.

* * * * *